United States Patent [19]

Holland et al.

[11] 4,080,919

[45] Mar. 28, 1978

[54] SAILBOAT TRAVELER APPARATUS

[75] Inventors: Andrew MacDonald Holland; Henry Leyva Arce, both of San Juan Capistrano, Calif.

[73] Assignee: Coast Catamaran Corporation, Irvine, Calif.

[21] Appl. No.: 708,573

[22] Filed: Jul. 26, 1976

[51] Int. Cl.[2] ..... B63H 9/08

[52] U.S. Cl. ..... 114/204; 114/112; 114/39

[58] Field of Search ..... 114/204, 112, 39

[56] References Cited

U.S. PATENT DOCUMENTS

| | | | |
|---|---|---|---|
| 75,012 | 3/1868 | Hart | 114/204 |
| 294,980 | 3/1884 | Field | 114/112 |
| 3,092,064 | 6/1963 | Benedict | 114/112 |
| 3,326,170 | 6/1967 | Lewery | 114/204 |
| 3,623,445 | 11/1971 | Holmes | 114/204 |
| 3,875,889 | 4/1975 | Robbins | 114/204 |

FOREIGN PATENT DOCUMENTS

| | | | |
|---|---|---|---|
| 9,138 of | 1895 | United Kingdom | 114/204 |

*Primary Examiner*—Trygve M. Blix
*Assistant Examiner*—Edward M. Wacyra
*Attorney, Agent, or Firm*—Fulwider, Patton, Rieber, Lee & Utecht

[57] ABSTRACT

A sailboat traveler apparatus with bearings having a circular cross section at their pivots which are received in a track with a circular cross section with the traveler carriage being pivotal about the centerline of the track so that pivoting forces on the carriage remain transferred to the bearing surfaces of the bearings and track without binding. The bearings may be spherical or cylindrical depending upon the desired friction between bearing and track.

13 Claims, 9 Drawing Figures

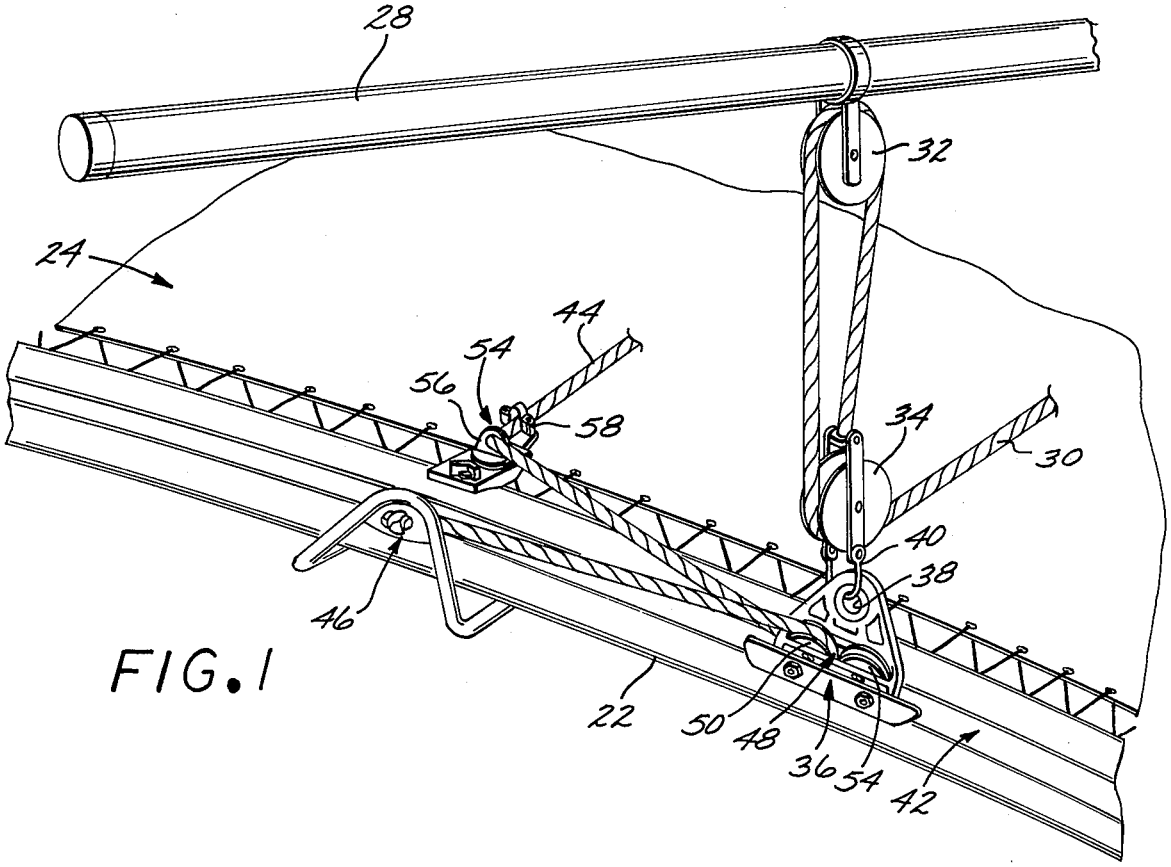
FIG. 1
FIG. 2
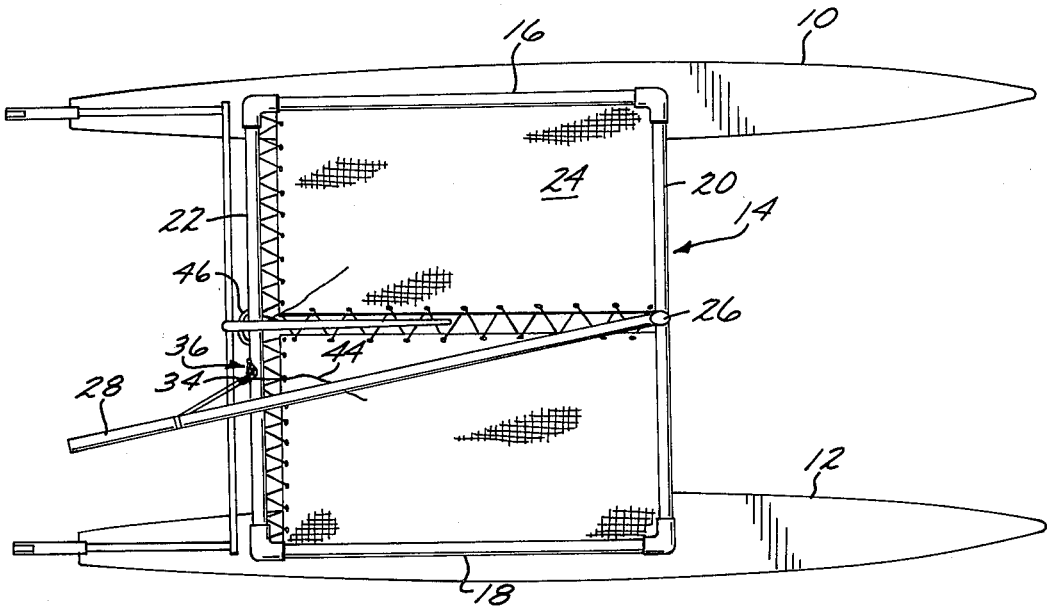

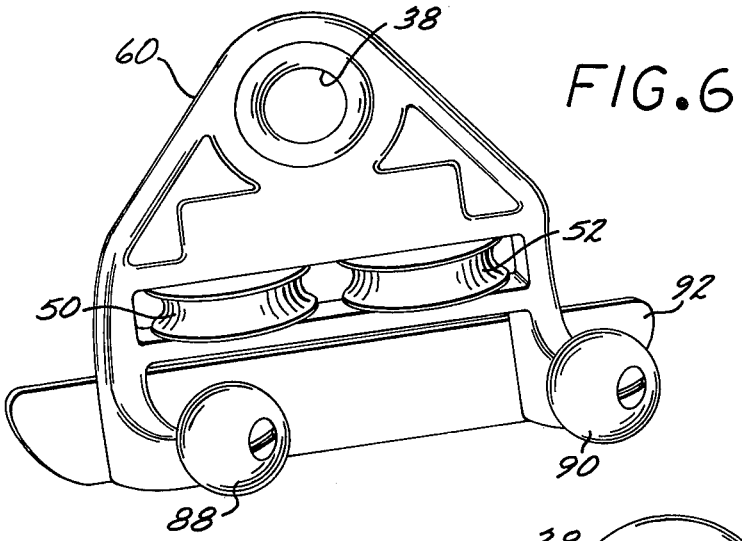
FIG. 6
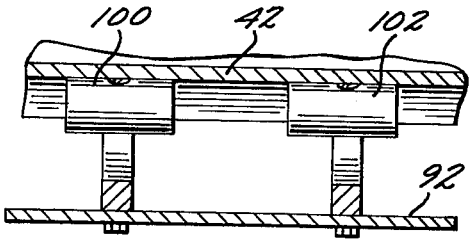
FIG. 9
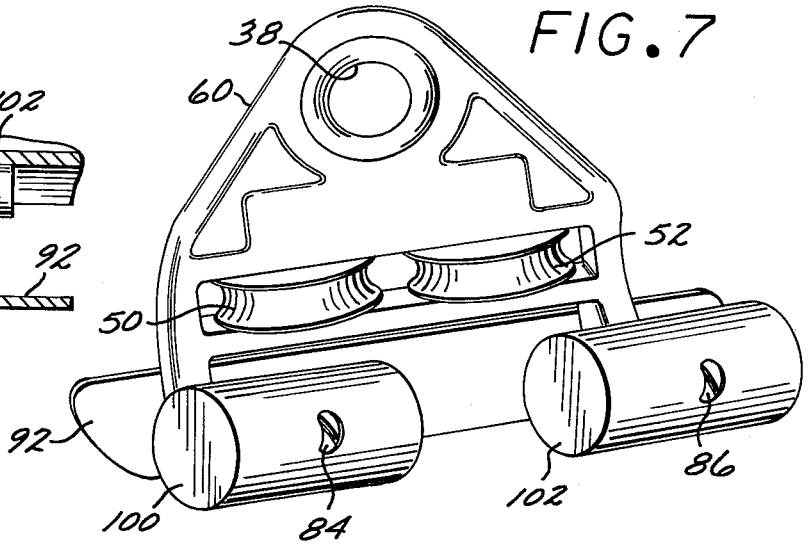
FIG. 7
FIG. 8
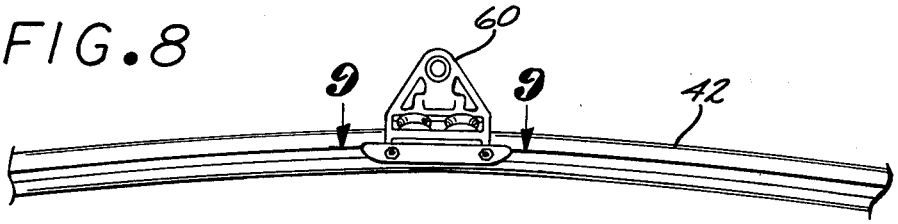

SAILBOAT TRAVELER APPARATUS

BACKGROUND OF THE INVENTION

1. Field of the Invention

The present invention relates generally to a sailboat traveler apparatus and more particularly to such travelers having bearings which will not bind in a track when the angle of pulling force on the traveler is changed.

2. Description of the Prior Art

Heretofore, travelers used in sailboats to position the point of downward pull on main sheets and the like moved in tracks having generally rectangular cross sections and the car or carriage of the travelers moved in the tracks on sliders or rollers. However, as the controlled equipment, such as the main boom, moved across the boat, the angle of pull on the traveler shifted and the traveler, particularly those using slides, bound in the track preventing easy movement. This is basically due to the fact that a sideward pull of the traveler within the track has less surface area to distribute the binding force than a pull along the direction of the track itself. This problem is particularly significant and even dangerous in some specialty boats such as catamarans where the crew has very limited range of movement and cannot easily reach the traveler to free it. The traveler apparatus of the present invention alleviates this problem.

SUMMARY OF THE INVENTION

The traveler apparatus of the present invention utilizes bearings having a substantially circular cross section at a pivot which are received in a track having a generally circular cross section. The traveler itself then may be pivoted on the bearings about the centerline of the track so that as the angle of pull is followed by the pivoting of the traveler carriage to maintain the force of pull on the bearings within the track to prevent binding. The circular cross sectional shape of the bearings within the circular track insures that the bearing forces are constantly substantially perpendicular to the bearing surfaces of the bearings and track.

Thus, the traveler apparatus of the present invention prevents binding of the traveler within the track, permitting the traveler carriage to pivot to follow the angle of pull.

BRIEF DESCRIPTION OF THE DRAWINGS

FIG. 1 is a broken-away perspective view of the traveler apparatus of the present invention installed on a catamaran;

FIG. 2 is a top plan view of the catamaran with the traveler apparatus installed;

FIG. 6 is a rearward-looking perspective of the first embodiment of the traveler;

FIG. 7 is a rearward-looking perspective view of a second embodiment of the traveler;

FIG. 8 is an elevational view of the second embodiment of the traveler mounted in a rear cross member in which it is preferably used; and FIG. 9 is a cross sectional view of the second embodiment of the traveler taken along the line 9—9 of FIG. 8.

DESCRIPTION OF THE PREFERRED EMBODIMENTS

Figure 3:
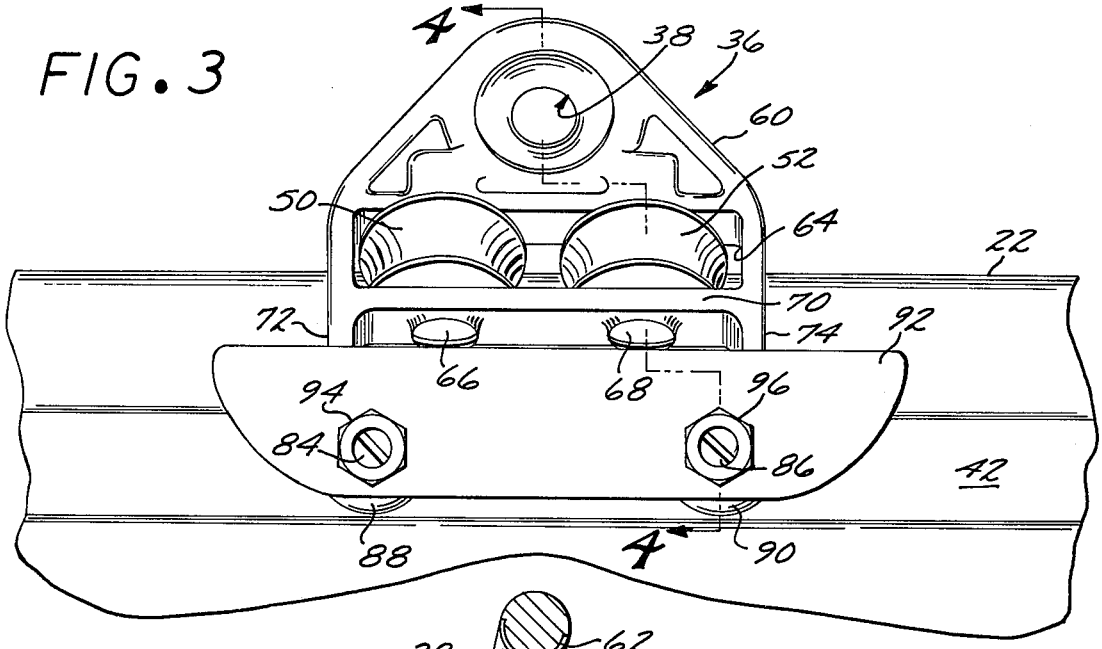
FIG. 3 is an elevational view of a first embodiment of the traveler of the invention shown in a first position.

Turning now to the drawings, and particularly FIGS. 1 and 2 thereof, the traveler apparatus of the invention is pictorially shown installed on a catamaran-type sailboat. Such a sailboat typically has two elongated hulls 10 and 12 which are maintained in a spaced lateral relationship by a rigid metal frame structure 14 generally made of hollow aluminum tubes.

The frame 14 has two side members 16 and 18 mounted along the centerlines of the hulls 10 and 12, respectively. The side members 16 and 18 are joined by forward and rear cross members 20 and 22, respectively, which not only rigidly join the hulls 10 and 12 together, but provide the framework for a trampoline-type stretched Dacron deck 24. The frame 14 also provides a mount for a conventional mast 26 from which is pivotally mounted a boom 28.

The angular position of the boom with respect to the centerline of the boat is conventionally controlled by a main sheet 30 which operates through a system of blocks 32 and 34 to pull the boom 28 toward a point along the rear cross bar 22 which is determined by the controlled position of a traveler 36, the construction of which is the subject of the present invention.

The lower block 34 of the main sheet 30 block system is fixed to an eye 38 by means of a conventional shackle 40 pivotally connected to the block 34. The traveler 36 rides in a track 42 in the rear cross bar 22 with its movement controlled by a control line 44 which runs from an outboard deadeye 46 through a fairlead 48 which includes a pair of roller sleeves 50 and 52 to a conventional swivel cam cleat 54 which has a swivel fairlead 56 and a cam cleat 58.

The details of the traveler apparatus of the present invention are more clearly shown in FIGS. 3–9. In particular, a carriage frame 60 has an eye 38 constructed in the apex of a generally triangularly-shaped upper end of the carriage. The deadeye is generally a circular hole through the carriage 60 with wear due to attached lines being reduced by the protective lining 62, as shown in FIG. 2.

The center of the carriage frame 60 has basically a rectangular hole 64 (FIGS. 6 and 7) in which are mounted a pair of fairlead roller sheaves 50 and 52, respectively, through which passes the control line 44, discussed above. Sheaves 50 and 52 are rotatably held in place by a pair of screws 66 and 68 inserted through a lower cross member 70 and threaded into the upper part of the rectangular hole 64.

Figure 4:
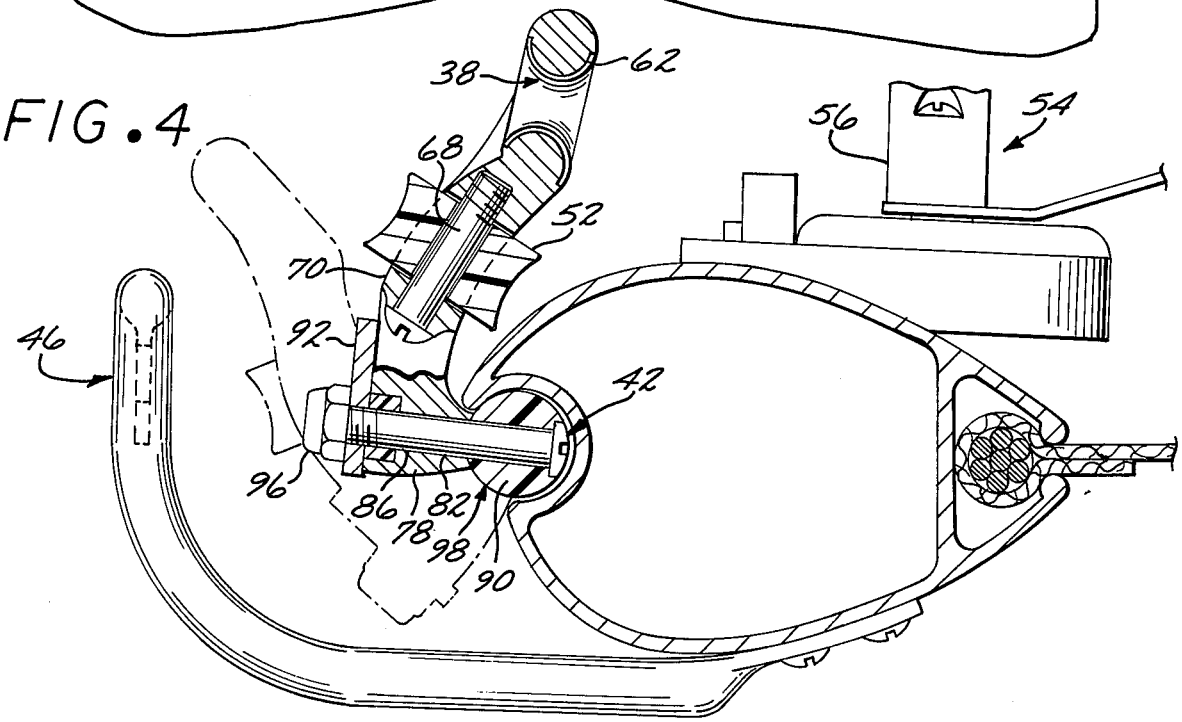
FIG. 4 is a partially sectioned side view of the first embodiment of the traveler, the section being taken along the line 4—4 of FIG. 3, with a tilted position shown in phantom.
Figure 5:
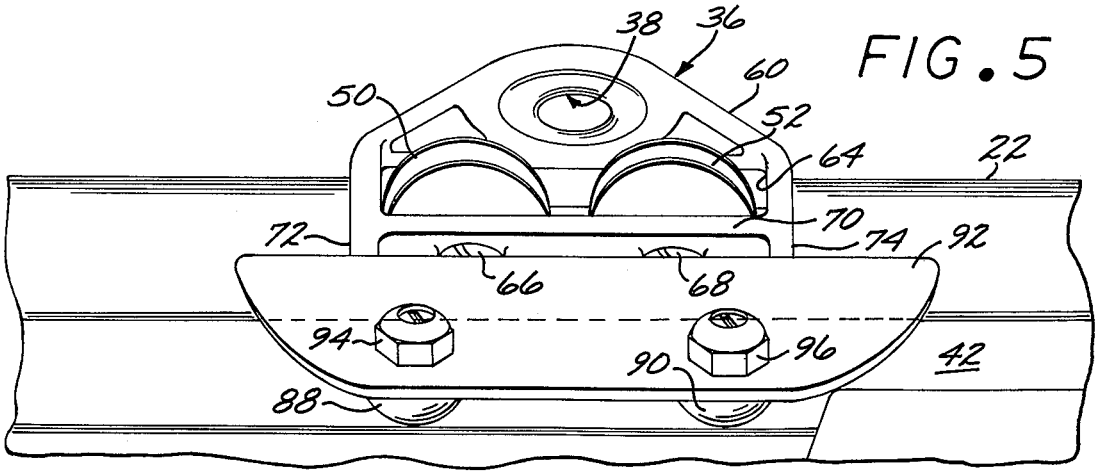
FIG. 5 is an elevational view of the first embodiment of the traveler shown in its second tilted position.

Downwardly extending from the sides of the carriage frame 60 are lower support members 72 and 74 (FIGS. 6 and 7) which end in enlarged bosses, such as that illustrated at 78 in FIGS. 4 and 6, which includes therethrough a mounting bore 82. On the forward surfaces of bore 82 is substantially perpendicularly mounted by means of axle bolts 84 and 86 a pair of spherically-shaped rollers 88 and 90, respectively, in a first embodiment of the invention (FIG. 6). On the threaded ends of bolts 84 and 86 is mounted a transverse support plate 92 held in position by nuts 94 and 96 on the ends of bolts 84 and 86, respectively.

Spherical rollers 88 and 90 are designed to fit and roll within track 42 which has a substantially circular cross section with a portion 98 of its circumference open substantially horizontally to receive the spherical rollers and supporting bolts 84 and 86 and bosses 76 and 78, respectively. The track itself may be straight or upwardly curved, as illustrated in FIG. 8. The portion 98 of the substantially circular cross section of track 42 is relatively large to permit the entire carriage frame 60 to pivot substantially about the centerline of the track about the spherical rollers 88 and 90 as illustrated in phantom in FIG. 4, but the portion 98 is insufficient to permit the spherical rollers 88 and 90 to be removed from track 42. Thus, it can be seen that as the angle of pull of the main sheet moves fore and aft as the angle of the boom 28 with respect to the centerline of the boat changes, the traveler 36 of the present invention pivots so that the force which is transferred to the spherical rollers 88 and 90 bears against the surface of the track 42. Thus, the forces exerted on the traveler, for most practical purposes, is substantially perpendicularly transferred to the bearing surfaces of the rollers 88 and 90 and the inside of the track 42 to reduce any binding to a minimum.

In a second embodiment of the traveler of the invention, the spherical rollers 88 and 90 are replaced by the cylindrical bearings 100 and 102 shown in FIGS. 7 and 9 which are pivotally mounted on the axle bolts 84 and 86 midway along their length. The second embodiment is preferably used when additional sliding friction is desired, such as when the curved track is used. The cylindrical bearings 100 and 102 still pivot about the centerline of the track to prevent binding, however.

Thus, the traveler apparatus of the present invention substantially reduces or eliminates binding of the traveler within its corresponding track by providing for the pivoting of the traveler itself on spherical or cylindrical bearings within a track having a circular cross section at their pivots or axles. The pull exerted on the traveler apparatus of the invention, by means of the pivoting, insures that the pulling force is continuously transferred substantially perpendicularly to roller and track bearing surfaces to minimize any binding.

While two presently preferred embodiments of the invention have been described in detail, it should be appreciated that numerous alternate forms of construction may be employed and that the invention is not to be limited except by the following claims.

We claim:

1. A traveler apparatus, comprising:

an elongated track having a substantially circular cross section, said track having a portion of its circumference open along its length; and a traveler carriage including a pair of bearings rotatably mounted on axles, said bearings having substantially circular cross sections along the axes of their axles and being mounted on said carriage and adapted to be received within said track with said axles of said bearings, extending through said open portion, said traveler carriage thereby being pivotal about the centerline of said track.

2. The traveler apparatus as defined in claim 1, wherein:

said open portion of said track is oriented in a substantially horizontal direction;

said bearings are substantially spherical rollers; and said carriage is oriented for receiving forces in a substantially vertical direction, the axis of rotation of said substantially spherical rollers being oriented in a substantially horizonal direction, whereby vertical forces applied to said carriage are substantially perpendicularly transferred to the bearing surfaces of said spherical rollers and track surface.

3. The traveler apparatus as defined in claim 2, wherein:

said orientation of said open portion of said track is such that the force applied to said carriage may deviate from the vertical and the carriage may pivot substantially about the centerline of the track while maintaining said bearing surfaces in contact.

4. The traveler apparatus as defined in claim 1, wherein:

said open portion of said track is oriented in a substantially horizontal direction;

said bearings are substantially cylindrical and have the axes of their axles substantially at the midpoint of their lengths; and said carriage is oriented for receiving forces in a substantially vertical direction, the axis of rotation of said substantially cylindrical bearings being oriented in a substantially horizontal direction, whereby vertical forces applied to said carriage are substantially perpendicularly transferred to the bearing surfaces of said cylindrical bearings and track surface.

5. The traveler apparatus as defined in claim 4, wherein:

said orientation of said open portion of said track is such that the force applied to said carriage may deviate from the vertical and the carriage may pivot substantially about the centerline of the track while maintaining said bearing surfaces in contact.

6. The traveler apparatus as defined in claim 1, wherein:

said open portion of said track is oriented in a substantially horizontal direction;

at least one of said bearings is a substantially spherical roller; and said carriage is oriented for receiving forces in a substantially vertical direction, the axis of rotation of at least one substantially spherical roller being oriented in a substantially horizontal direction, whereby vertical forces applied to said carriage are substantially perpendicularly transferred to the bearing surfaces of said at least one spherical roller and said track surface.

7. The traveler apparatus as defined in claim 1 wherein:

said open portion of said track is oriented in a substantially horizontal direction;

at least one of said bearings is substantially cylindrical and has it pivot point substantially at the midpoint of its length; and said carriage is oriented for receiving forces in a substantially vertical direction, the axis of rotation of said substantially cylindrical bearing being oriented in a substantially horizontal direction, whereby vertical forces applied to said carriage are substantially perpendicularly transferred to the bearing surfaces of said bearings said track surface.

8. A traveler apparatus, comprising:

an elongated track having a substantially circular inside cross section, said track having a portion of its circumference open along its length in a substantially horizontal orientation; and a traveler carriage having an eye at one end and at least one spherical roller at an opposite end thereof mounted on an axle, said spherical roller being received within said track with said axle extending through said open portion, said carriage being oriented for receiving forces at said eye in a substantially vertical direction, said forces being communicated to the bearing surfaces of said spherical rollers and track surface substantially perpendicularly.

9. A traveler apparatus as defined in claim 8, wherein:

two spherical rollers are mounted on said carriage, spaced horizontally on either side of said eye.

10. A traveler apparatus comprising:

a track having a substantially circular inside cross-section, said track having a portion of its circumference open in a substantially horizontal orientation;

a traveler carriage having an eye at one end and two spherical rollers mounted on said carriage and spaced horizontally on either side of said eye, said spherical rollers being received within said track through said open portion, said carrriage being oriented for receiving forces at said eye in a substantially vertical direction, said forces being communicated to the bearing surfaces of said spherical rollers and track surface substantially perpendicularly; and a pair of roller sheaves mounted on said carriage between said spherical rollers and said eye, said roller sheaves being laterally spaced to define a fairlead for receiving a control line for said traveler apparatus.

11. A traveler apparatus, comprising:

an elongated track having a substantially circular inside cross section, said track having a portion of its circumference open along its length in a substantially horizontal orientation; and a traveler carriage having an eye at one end and at least one cylindrical bearing at an opposite end thereof, said cylindrical bearing being mounted substantially at the midpoint of its length on an axle which is substantially perpendicular to a plane of said carriage, said cylindrical bearing being received within said track with said axle extending through said open portion, said carriage being oriented for receiving forces at said eye in a substantially vertical direction, said forces being communicated to the bearing surfaces of said cylindrical bearings and track surface substantially perpendicularly.

12. A traveler apparatus as defined in claim 11, wherein:

two cylindrical bearings are mounted on said carriage, spaced horizontally on either side of said eye.

13. A traveler apparatus, comprising:

a track having a substantially circular inside cross section, said track having a portion of its circumference open in a substantially orientation;

a traveler carriage having an eye at one end and two cylindrical bearings mounted on said carriage and spaced horizontally on either side of said eye, said cylindrical bearings being mounted substantially at midpoints of their length on axles which are substantially perpendicular to a plane of said carriage, said cylindrical bearings being received within said track within said open portion, said carriage being oriented for receiving forces at said eye in a substantially vertical direction, said forces being communicated to the bearing surfaces of said cylindrical bearings and track surface substantially perpendicularly; and a pair of roller sheaves mounted on said carriage between said cylindrical bearings and said eye, said roller sheaves being laterally spaced to define a fairlead for receiving a control line for said traveler apparatus.

* * * * *